United States Patent [19]

Brambilla et al.

[11] Patent Number: 5,001,414

[45] Date of Patent: Mar. 19, 1991

[54] VOLTAGE REFERENCE CIRCUIT WITH LINEARIZED TEMPERATURE BEHAVIOR

[75] Inventors: Massimiliano Brambilla, Sesto San Giovanni; Marco Morelli, Livorno; Giampietro Maggioni, Cornaredo, all of Italy; Paolo Menegoli, Phoenix, Ariz.

[73] Assignee: Thomson Microelectronics, Brianza, Italy

[21] Appl. No.: 440,034

[22] Filed: Nov. 21, 1989

[30] Foreign Application Priority Data

Nov. 23, 1988 [IT] Italy ..... 22710 A/88

[51] Int. Cl.[5] ..... G05F 3/30

[52] U.S. Cl. ..... 323/313; 323/907

[58] Field of Search ..... 323/313, 314, 907

[56] References Cited

U.S. PATENT DOCUMENTS

| | | | |
|---|---|---|---|
| 4,249,122 | 2/1981 | Widlar | 323/313 |
| 4,250,445 | 2/1981 | Brokaw | 323/313 |
| 4,325,017 | 4/1982 | Schade | 323/907 |
| 4,362,984 | 12/1982 | Holland | 323/907 |
| 4,490,670 | 2/1984 | Wong | 323/313 |
| 4,603,291 | 7/1986 | Nelson | 323/907 |
| 4,797,577 | 1/1989 | Hing | 323/907 |
| 4,808,908 | 2/1989 | Lewis et al. | 323/907 |
| 4,843,302 | 6/1989 | Dobkin et al. | 323/907 |
| 4,939,442 | 7/1990 | Carvajal et al. | 323/281 |

FOREIGN PATENT DOCUMENTS

| | | |
|---|---|---|
| 252320 | 1/1988 | European Pat. Off. . |
| 2040087 | 8/1980 | United Kingdom . |
| 2199677 | 7/1988 | United Kingdom . |

*Primary Examiner*—William H. Beha, Jr.

*Attorney, Agent, or Firm*—Wolf, Greenfield & Sacks

[57] ABSTRACT

This voltage reference circuit has high thermal stability and minimal bulk and comprises a transistor defining a base-emitter junction having a voltage drop which varies in a non-linear manner as a function of temperature and resistors connected in series to the junction, the junction and the resistors being interposed between a ground line and the output terminal. A compensation transistor generates a compensation current which varies as a function of temperature so as to produce a voltage drop with a behavior substantially opposite to the previous voltage drop upon reaching the switching on temperature of the transistor.

5 Claims, 2 Drawing Sheets

VOLTAGE REFERENCE CIRCUIT WITH LINEARIZED TEMPERATURE BEHAVIOR

BACKGROUND OF THE INVENTION

The present invention relates to a voltage reference circuit with linearized temperature behavior.

As is known, the voltage reference is an essential block of integrated circuits. Said block can comprise configurations using Zener diodes or a so-called band-gap structure, a typical configuration whereof is shown in FIG. 1. Said illustrated structure is currently preferred to configurations using Zener diodes, since it has some advantages, among which the low value of its output voltage, typically 1.2 V, which allows to extend its compatibility with power supply sources, and good thermal stability.

With reference to the diagram of FIG. 1, in particular to the transistors $Q_1$ and $Q_2$, simple calculations show that $$V_{REF} = V_{BE} + 2\frac{R_2}{R_1}\Delta V_{BE}$$

in which $$V_{BE} = \eta V_T \ln \frac{I_C}{I_S}$$

$$\Delta V_{BE} = \eta V_T \ln A$$

where A is the ratio between the emitter areas of $Q_1$ and $Q_2$; $I_S$ is the converse saturation current, $$V_T = \frac{KT}{q}\theta\eta$$

is a corrective parameter which is related to the employed technology and is independent from the temperature.

By derivation with respect to the temperature, the following is obtained:

$$\frac{\partial V_{REF}}{\partial T} = \frac{\partial V_{BE}}{\partial T} + 2\frac{R_2}{R_1}\frac{\partial \Delta V_{BE}}{\partial T}$$

By analyzing this last equation, it has been seen that $\partial\Delta V_{BE}/\partial T$ is constant and positive, and therefore the primitive function has a rising linear behavior; while $\partial V_{BE}/\partial T$ is not constant and is negative, and therefore the voltage $V_{BE}(T)$ has a non-linear decreasing behavior. This situation is exemplified in FIGS. 2*a* and 2*b*, which respectively illustrate the derivative of the voltage drop on $R_2$ (directly proportional to the derivative of $\Delta V_{BE}$ with respect to the temperature) and the derivative of the base-emitter drop with respect to the temperature.

In a significant temperature range (typical for applications in the motor-vehicle field) comprised between −40° C. and 150° C., three different situations are possible, namely:

if $\partial V_{BE}/\partial T > \partial\alpha\Delta V_{BE}/\partial T$ in absolute value in the entire range being considered, the voltage $V_{REF}(T)$ will have an always decreasing behavior;

if instead $\partial V_{BE}/\partial T < \partial\alpha\Delta V_{BE}/\partial T$ (always in absolute value in the entire range), $V_{REF}(T)$ will always have a rising behavior;

if, always within the initially considered range, the second of the two described conditions is true initially and the first one is subsequently true, the derivative of the voltage $V_{REF}(T)$ with respect to the temperature will be initially positive and subsequently negative (see FIG. 2*c*) and the primitive function will have a parabolic plot.

More generally, it can be said that the voltage $V_{REF}$ has a parabolic behavior in which the position of the maximum value can be internal or external to the temperature range being considered. With a same voltage $V_{BE}$, the position of this point is linked to the voltage $V_{REF}$ to be obtained at a given reference temperature (environmental temperature is usually considered). This reference voltage value therefore determines the value of the resistor $R_2$.

These conclusions are illustrated in FIGS. 2*a*, 2*b*, 2*c* and 3, in which three different values of the resistor $R_2$ have been assumed and therefore three different plots have been obtained. In particular, the curves 1, 2 and 3 relate to decreasing values of the resistor $R_2$ which entail a shift of the sign-change point of the curve $\partial V_{REF}/\partial T$, i.e. a variation in the slop-change point of the primitive, which will therefore have one of the three behaviors shown in FIG. 3. This behavior is in any case merely theoretical, as it is determined by solving a mathematical equation; in practive, however, the unavoidable process spreads make such a behavior unattainable.

SUMMARY OF THE INVENTION

Given this situation, the problem arises of limiting the variation of the reference voltage as a function of temperature by providing means for linearizing the behavior of said voltage.

Within this aim, a particular object of the present invention is to improve the stability and reduce the temperature-dependence of the reference voltage with a circuit having minimum bulk.

Another object of the present invention is to provide a simple compensation system which can be easily integrated in the voltage reference circuit and operates reliably.

This aim, the mentioned objects and others which will become apparent hereinafter are achieved by a voltage reference circuit with linearized temperature behavior, as defined in the accompanying claims.

BRIEF DESCRIPTION OF THE DRAWINGS

The characteristics and advantages of the invention will become apparent from the description of a preferred but not exclusive embodiment, illustrated only by way of non-limitative example in the accompanying drawings, wherein:

FIGS. 1 to 3 are not described hereafter; reference is made for said figures to the introductory section of the present patent (for the diagram of FIG. 1, see also A. Paul BROKAW, "Single terminal three IC reference", I.E.E.E. Journal of Solid State Circuits, Vol. SC9, No. 6, Dec. 1974, pages 389-393).

DESCRIPTION OF THE PREFERRED EMBODIMENTS

Figure 1:
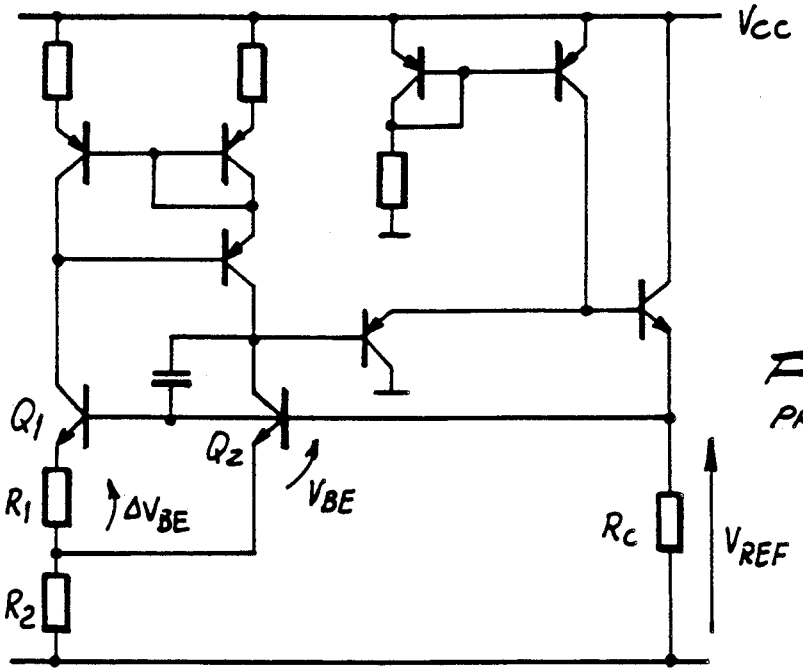
Fig. 1 PRIOR ART
FIG. 1 is a simplified circuit diagram of a known voltage reference in band-gap configuration.
Figure 2A:
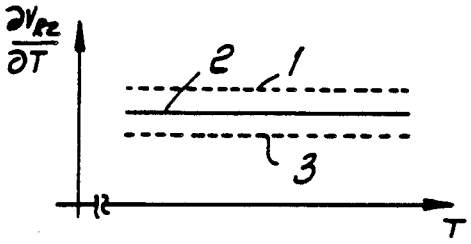
Fig. 2a PRIOR ART
FIGS. 2*a*, 2*b*, 2*c* and 3 represent possible plots of the voltages and derivatives thereof of the circuit of FIG. 1.
Figure 2B:
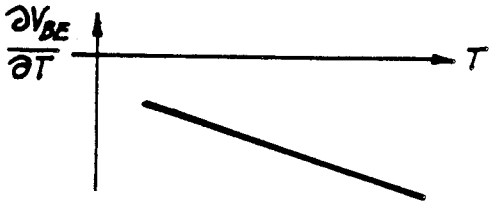
Fig. 2b PRIOR ART
Figure 2C:
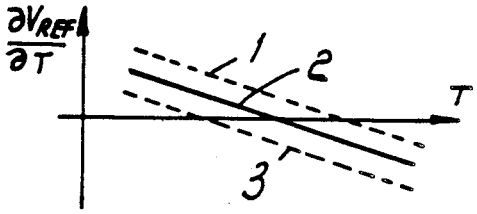
Fig. 2c PRIOR ART
Figure 4:
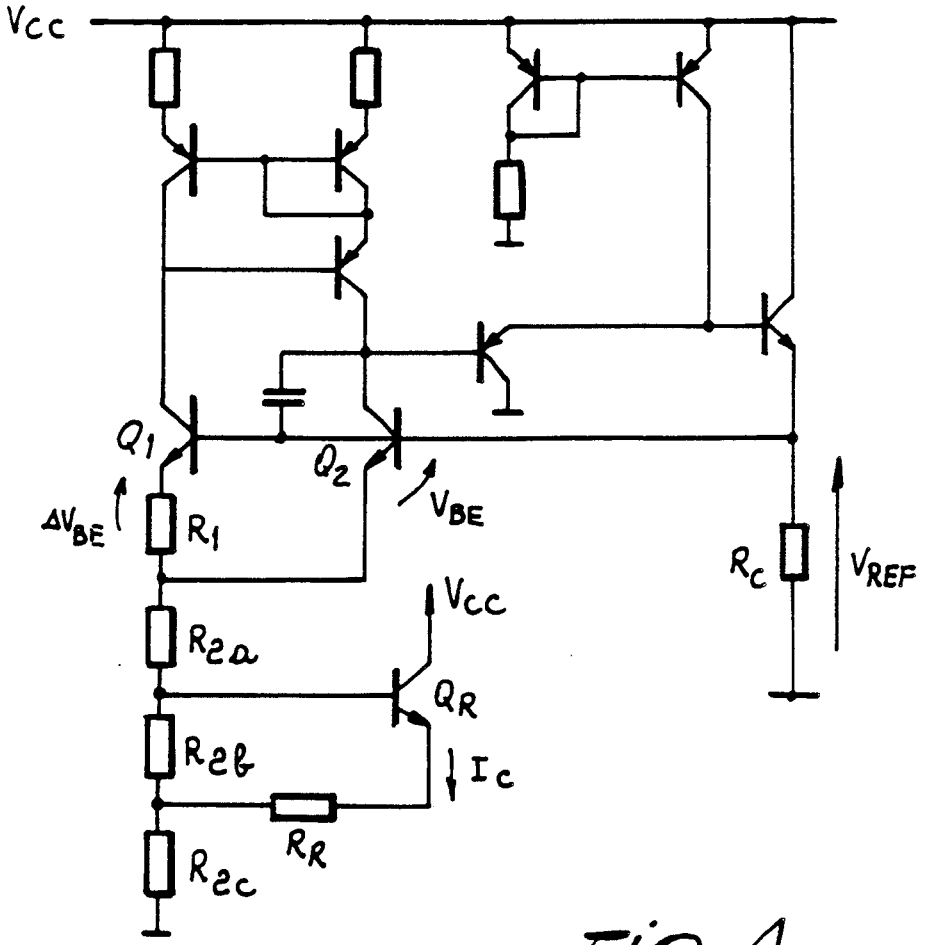
FIG. 4 is a simplfied circuit diagram of the structure of FIG. 1, modified according to the invention.

Reference is thus made to FIG. 4, which illustrates a voltage reference circuit in band-gap configuration according to the invention. Sucn circuit substantially corresponds to the one of FIG. 1, except for the fact that the resistor $R_2$ has been replaced by three resistors $R_2a$, $R_2b$, and $R_2c$ arranged mutually in series and connected to the emitter of $Q_2$ and to a terminal of $R_1$ on one side and to the ground on the other. The circuit furthermore comprises and NPN-type transistor $Q_R$ which has its base connected to the common point between $R_2a$ and $R_2b$, its collector connected to the supply voltage $V_{CC}$ and its emitter connected through a resistor $R_R$ to the common point between $R_2b$ and $R_2c$.

If the resistor $R_R$ is temporarily ignored, the collector current $I_C$ and the base to emitter voltage drop $V_{BE}$ of transistor $Q_R$ are as follows:

$$I_C = I_S \exp \frac{V_{BE}}{\eta V_T}$$

$$V_{BE} = 2\frac{R_{2b}}{R_1}\Delta V_{BE} = 2\frac{R_{2b}}{R_1}\eta V_T \ln A$$

from which $$I_C = I_S \exp\left(2\frac{R_{2b}}{R_1}\ln A\right)$$

This current has a parabolic temperature-dependence which is due exclusively to the current $I_S$, the value whereof doubles approximately every 10° C. By injecting this current in the resistor $R_2c$, an additional term for the voltage $V_{REF}$ is obtained, able to compensate the natural behavior.

By employing this current it is therefore possible to compensate the variation of the refence voltage $V_{REF}$ starting from a given temperature. Infact, on the basis of the above, the voltage on the resistors $R_2$ and therefore in particular on $R_2b$, which is proportional to $\Delta V_{BE}$, rises with the temperature, while the voltage on the base-emitter junction of $Q_R$ decreases with the temperature. At a given temperature, therefore, $V_{R2b}=V_{BE}$, i.e. the transistor $Q_R$ is switched on.

With the illustrated diagram, the transistor $Q_R$ will tend to conduct increasingly as the temperature rises. Therefore the resistor $R_R$ has been inserted in order to make switching on of said transistor more gradual.

Figure 3:
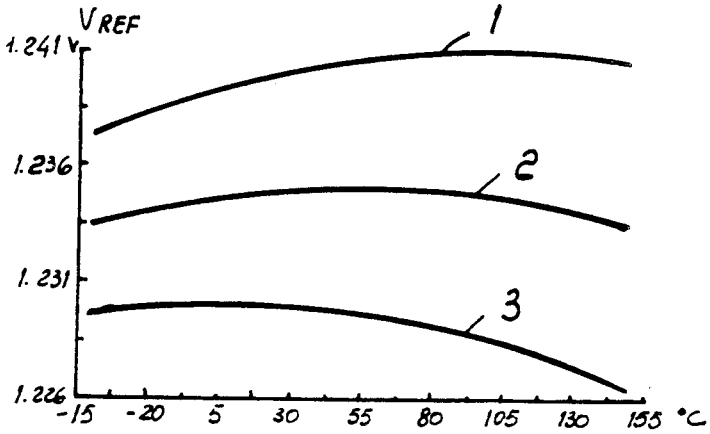
Fig. 3 PRIOR ART

Since the action of the transistor $Q_R$ is limited to high temperatures, the compensation is optimized starting from a reference voltage behavior having its maximum value at low temperatures, i.e. in the condition shown by the curve 3 of FIG. 3, which can be obtained, as mentioned, by appropriately setting the value of $R_2b$.

Figure 5:
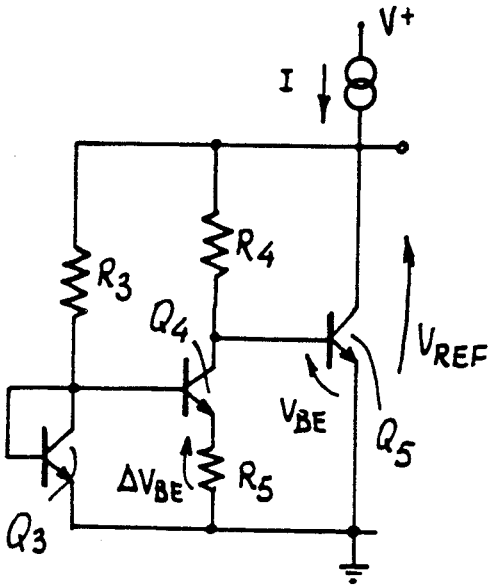
Fig. 5 PRIOR ART
FIG. 5 is a simplified circuit diagram of another configuration of a known voltage reference.

The same inventive concept can be applied to a reference voltage according to Widlar's theory, of which FIG. 5 illustrates a typical non-linearized structure.

For this known configuration, the output voltage $V_{REF}$ is given by the base-emitter drop on the transistor $Q_5$ plus the drop on $R_4$, and therefore:

$$V_{REF} = V_{BE} + \frac{R_4}{R_5}\Delta V_{BE}$$

Figure 6:
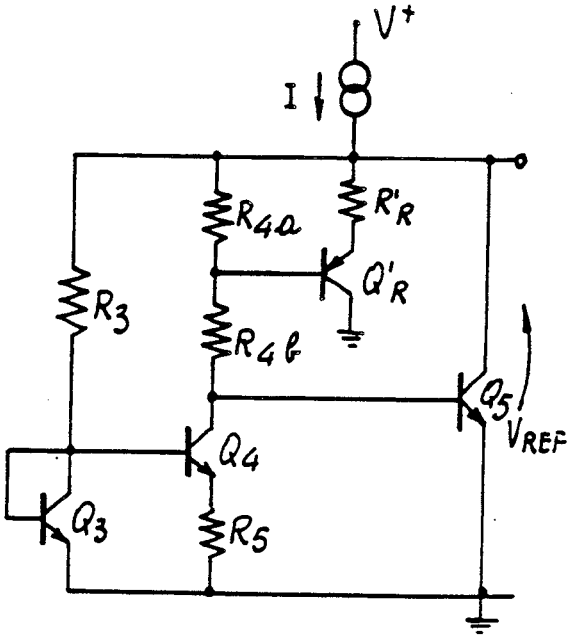
FIG. 6 is a modification, according to the invention, of the diagram of FIG. 5.

The considerations presented above are therefore valid for this circuit, and in general the output reference voltage will have a parabolic plot which can be compensated at high temperatures by using the diagram shown in FIG. 6.

As can be seen in said figure, similarly to the solution illustrated in FIG. 4, the resistor $R_4$ has been divided into the two resistors $R_4a$ and $R_4b$, and the PNP-type transistor $Q'_R$ has been inserted; said transistor has its collector connected to the ground, its base connected to the common point between $R_4a$ and $R_4b$ and its emitter connected to the resistor $R'_R$ which has its other terminal connected to the upper portion of the circuit, which has been schematically represented by the current source I.

The temperature compensation of the circuit of FIG. 6 operates similarly to the one shown in FIG. 4; specifically, $R_4a$ is the equivalent of $R_2b$ and sets the switching on temperatue of the recovery or compensation transistor $Q'_R$; $R_4b$ is the equivalent of the resistor $R_2c$ and therefore sets the recovery voltage (as it receives the base current of the transistor $Q'_R$ after switching on thereof) and $R'_R$ makes the action of the recovery transistor more gradual.

As can be seen from the previous description, the invention achieves the proposed aims. In particular, by virtue of the insertion of the compensation transistors, in known circuits, a current source is inserted which injects a recovery current starting from a voltage which can be set by appropriately dimensioning of the circuit. Said current, injected in $R_2c$ or $R_4b$, allows to compensate or at least reduce the negative slope of the reference voltage as the temperature rises.

The illustrated solution is furthermore extremely simple, since it consists in inserting a transistor and resistors without further modification of the known circuit, entails a reduced bulk and can be easily integrated.

The invention thus conceived is susceptible to numerous modifications and variations, all of which are within the scope of the inventive concept.

Finally, all the details may be replaced with other technically equivalent ones.

We claim:

1. A voltage reference circuit with a linearized temperature behavior, comprising a transistor including a base-emitter junction having a junction voltage drop which is variable in a non-linear manner as a function of temperature, resistive means connected in series to said junction, said junction and said resistive means being interposed between a reference potential line and an output terminal, and variable current source means feeding said resistive means with a compensation current which is variable as a function of the temperature so as to produce a voltage drop with a behavior which is substantially opposite to said junction voltage drop in at least one operating range of said circuit, wherein said current source means comprise a compensation transistor for feeding said compensation current and said voltage reference circuit further comprising circuit means for switching on said compensation transistor at a given operating temperature.

2. A circuit according to claim 1, of the band-gap type, comprising a first and a second transistors having their collector terminals connected to a respective current source, their base terminals conected together and their emitter terminals connected together through a first resistive element, said emitter terminals of said first and second transistors being connected to said resistive means, wherein said resistive means comprise at least one second and one third resistive elements mutually connected in series with a first terminal thereof, said second resistive element having a second terminal connected to said emitter terminal of said first and second transistors and said third resistive element having an own second terminal connected to a ground line, said second resistive element being furthermore connected in parallel to a base-emitter junction of a compensation transistor defining said variable current source means and setting the switching on temperature of said compensation transistor.

3. A circuit according to claim 2, comprising a fourth resistive element connected in series to the emitter of said compensation transistor.

4. A circuit according to claim 3, of the Widlar type, comprising a transistor connected between said output terminal and a ground line with its own collector and emitter terminals to a terminal of said resistive means with its own base terminal, said resistive means having another terminal connected to said output terminal, wherein said resistive means comprise a first and a second resistive elements mutually connected with a first terminal thereof, said first resistive element having a second terminal connected to said own base terminal of said transistor, said second resistive element having an own second terminal connected to said output terminal, said second resistive element being connected in parallel to the base-emitter junction of a compensation transistor defining said variable current source means, with said second resistive terminal setting the switching on temperature of said compensation transistor.

5. A circuit according to claim 4, comprising a third resistive element connected in series to the emitter terminal of said compensation transistor.

* * * * *

UNITED STATES PATENT AND TRADEMARK OFFICE

CERTIFICATE OF CORRECTION

PATENT NO. : 5,001,414
DATED : March 19, 1991

INVENTOR(S) : Massimiliano Brambilla et al.

It is certified that error appears in the above—identified patent and that said Letters Patent is hereby corrected as shown below:

On the cover sheet of the patent under the designation of Assignee, please change the present designation of "Thomson Microelectronics, Brianza, Italy" to -- SGS-Thomson Microelectronics S.r.l., Agrate, Brianza (Prov. of Milano), Italy --.

Signed and Sealed this

Twelfth Day of May, 1992

*Attest:*

DOUGLAS B. COMER

*Attesting Officer*

*Acting Commissioner of Patents and Trademarks*